US005786774A

United States Patent [19]

Sabol

[11] Patent Number: 5,786,774

[45] Date of Patent: Jul. 28, 1998

[54] ALARM MODULE

[76] Inventor: Joseph M. Sabol, 41 Amherst Dr., Burlington, N.J. 08016

[21] Appl. No.: 871,258

[22] Filed: Jun. 9, 1997

[51] Int. Cl.[6] ..... G08B 23/00

[52] U.S. Cl. ..... 340/984; 340/525; 340/461; 701/29

[58] Field of Search ..... 340/984, 525, 340/461, 462, 439, 441, 449, 459, 438; 701/30, 29, 35; 440/2, 38; 441/36

[56] References Cited

U.S. PATENT DOCUMENTS

| | | | |
|---|---|---|---|
| 4,914,419 | 4/1990 | Bragenzer et al. | 340/459 |
| 4,933,852 | 6/1990 | Lemelson | 701/30 |
| 5,063,381 | 11/1991 | Ito | 340/984 |
| 5,216,421 | 6/1993 | Swada et al. | 340/984 |
| 5,625,337 | 4/1997 | Medawar | 340/449 |

*Primary Examiner*—Jeffrey A. Hofsass
*Assistant Examiner*—Benjamin C. Lee

[57] ABSTRACT

An alarm module system including at least one electronic display module situated on a boat with a display for indicating the status of the vital functions of the engine of the boat. The electronic display is adapted to produce an activation signal upon detection of an anomaly within the engine. Further included is a direct current battery supply for supplying power and an alarm horn for generating an audible alarm upon the receipt of power. Also provided is an interconnection network including power means having at least one voltage regulator connected to the battery supply for providing a lesser voltage an output thereof. The voltage regulator has a pair of capacitors of unequal capacitance connected in parallel between the output of the associated voltage regulator and a ground. The interconnection network further includes switch means having an input terminal connected to the electronic display module for receiving the activation signal therefrom. A first relay coil is connected to the input terminal with an associated first normally open relay contact connected to the output of the at least one voltage regulator of the power means for closing upon the receipt of the activation signal by the first relay coil. Associated therewith is a second relay coil connected between the first relay contact and ground. Lastly, a second normally open relay contact is connected between the battery supply and the alarm horn for supplying power to the horn upon the closing of the first relay contact.

6 Claims, 1 Drawing Sheet

ALARM MODULE

BACKGROUND OF THE INVENTION

1. Field of the Invention

The present invention relates to a alarm module and more particularly pertains to providing a reliable means of transmitting a secondary high intensity alarm upon the detection of engine trouble aboard a watercraft.

2. Description of the Prior Art

The use of boat alarms is known in the prior art. More specifically, boat alarms heretofore devised and utilized for the purpose of indicating engine troubles are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,113,173 to Lawson; U.S. Pat. No. 4,630,036 to Ford; U.S. Pat. No. 5,051,744 to Ewart; U.S. Pat. No. 4,914,419 to Bragenzer et al.; U.S. Pat. No. 4,598,270 to Shutt et al.; and U.S. Pat. No. 4,962,371 to Repp et al.

In this respect, the alarm module according to the present invention substantially departs from the conventional concepts and designs of the prior art, and in so doing provides an apparatus primarily developed for the purpose of providing a reliable means of transmitting a secondary high intensity alarm upon the detection of engine trouble aboard a watercraft.

Therefore, it can be appreciated that there exists a continuing need for a new and improved alarm module which can be used for providing a reliable means of transmitting a secondary high intensity alarm upon the detection of engine trouble aboard a watercraft. In this regard, the present invention substantially fulfills this need.

SUMMARY OF THE INVENTION

In view of the foregoing disadvantages inherent in the known types of boat alarms now present in the prior art, the present invention provides an improved alarm module. As such, the general purpose of the present invention, which will be described subsequently in greater detail, is to provide a new and improved alarm module which has all the advantages of the prior art and none of the disadvantages.

To attain this, the present invention essentially comprises a first electronic display module situated on a starboard side of a boat with a display for indicating the status of vital functions of an engine of the boat. In use, the first electronic display is adapted to produce an activation signal upon detection of an anomaly within the engine. Associated therewith is a second electronic display module situated on a port side of a boat. Note FIG. 1. The second electronic display module is also equipped with a display for indicating the status of the vital functions of the engine of the boat. In operation, the second electronic display is adapted to produce an activation signal upon detection of an anomaly within the engine. Also included is a 12 Volt direct current battery supply for supplying power. As shown in FIG. 1, an alarm horn is provided for generating an audible alarm upon the receipt of power. With reference now to FIG. 2, an interconnection network is included which has a power means. Such power means comprises a pair of voltage regulators each with an input connected to the battery supply for providing a voltage of 5 Volts at an output thereof. Each voltage regulator has a pair of capacitors of unequal capacitance connected in parallel between the output of the associated voltage regulator and a ground. In addition, the power means of the interconnection network further includes a light emitting diode which is connected to the output of a first one of the voltage regulators. Such light emitting diode is adapted for indicating the presence of a voltage at the output of the first voltage regulator. A pair of power terminals are both connected to the output of the first voltage regulator for being connected to the first and second electronic display modules. These terminals are provided for supplying power to the electronic display modules. With reference still to FIG. 2, it can be seen that the interconnection network also has a switch means. Such means includes a pair of input terminals connected to the electronic display modules for receiving the activation signal therefrom. A first and second diode are provided each having an anode connected to an associated input terminal and cathodes which are interconnected. Connected to cathodes of the first and second diodes is a first relay coil with a third diode connected in parallel therewith. Associated with such relay coil is a first, normally open, relay contact connected to the output of a second one of the voltage regulators of the power means. In use, the first relay contact is adapted for closing upon the receipt of the activation signal by the first relay coil. A second relay coil is connected between the first relay contact and ground with a fourth diode connected in parallel therewith. Finally, a second normally open relay contact is connected between the battery supply and the alarm horn. In use, the second relay contact supplies power to the horn upon the closing of the first relay contact.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved alarm module which has all the advantages of the prior art boat alarms and none of the disadvantages.

It is another object of the present invention to provide a new and improved alarm module which may be easily and efficiently manufactured and marketed.

It is a further object of the present invention to provide a new and improved alarm module which is of a durable and reliable construction.

An even further object of the present invention is to provide a new and improved alarm module which is susceptible of a low cost of manufacture with regard to both materials and labor, and which accordingly is then susceptible of low prices of sale to the consuming public, thereby making such alarm module economically available to the buying public.

Still yet another object of the present invention is to provide a new and improved alarm module which provides in the apparatuses and methods of the prior art some of the advantages thereof, while simultaneously overcoming some of the disadvantages normally associated therewith.

Still another object of the present invention is to provide a reliable means of transmitting a secondary high intensity alarm upon the detection of engine trouble aboard a watercraft.

Lastly, it is an object of the present invention to provide a new and improved alarm module system including at least one electronic display module situated on a boat with a display for indicating the status of the vital functions of the engine of the boat. The electronic display is adapted to produce an activation signal upon detection of an anomaly within the engine. Further included is a direct current battery supply for supplying power and an alarm horn for generating an audible alarm upon the receipt of power. Also provided is an interconnection network including power means having at least one voltage regulator connected to the battery supply for providing a lesser voltage an output thereof. The voltage regulator has a pair of capacitors of unequal capacitance connected in parallel between the output of the associated voltage regulator and a ground. The interconnection network further includes switch means having an input terminal connected to the electronic display module for receiving the activation signal therefrom. A first relay coil is connected to the input terminal with an associated first normally open relay contact connected to the output of the at least one voltage regulator of the power means for closing upon the receipt of the activation signal by the first relay coil. Associated therewith is a second relay coil connected between the first relay contact and ground. Lastly, a second normally open relay contact is connected between the battery supply and the alarm horn for supplying power to the horn upon the closing of the first relay contact.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
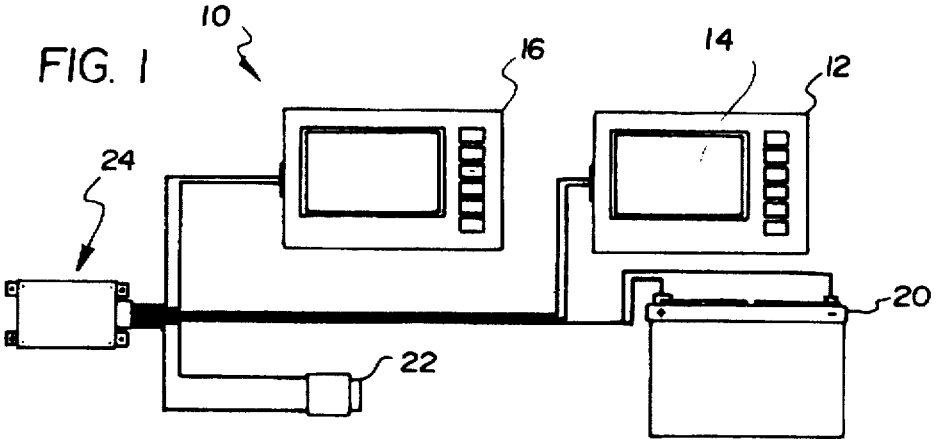
FIG. 1 is a perspective illustration of the preferred embodiment of the alarm module constructed in accordance with the principles of the present invention.

With reference now to the drawings, and in particular to FIG. 1 thereof, a new and improved alarm module embodying the principles and concepts of the present invention and generally designated by the reference numeral 10 will be described.

The present invention, the new and improved alarm module, is comprised of a plurality of components. Such components in their broadest context include a pair of electronic display modules, battery, alarm horn, and interconnection network. Such components are individually configured and correlated with respect to each other so as to attain the desired objective.

More specifically, it will be noted that the system 10 of the present invention includes a first electronic display module 12 situated on a starboard side of a boat with a display 14 for indicating the status of vital functions of an engine of the boat. In use, the first electronic display is adapted to produce an activation signal upon detection of an anomaly within the engine. Associated therewith is a second electronic display module 16 situated on a port side of a boat. Note FIG. 1. The second electronic display module is also equipped with a display for indicating the status of the vital functions of the engine of the boat. In operation, the second electronic display is adapted to produce an activation signal upon detection of an anomaly within the engine. It should be noted that the detection of an anomaly within the engine is accomplished by way of an oil pressure indicator, temperature gauge, or the like.

Also included is a 12 Volt direct current battery supply 20 for supplying power. As shown in FIG. 1, an alarm horn 22 is provided for generating an audible alarm upon the receipt of power. Such audible alarm preferably takes the form of a plurality of high intensity blasts.

Figure 2:
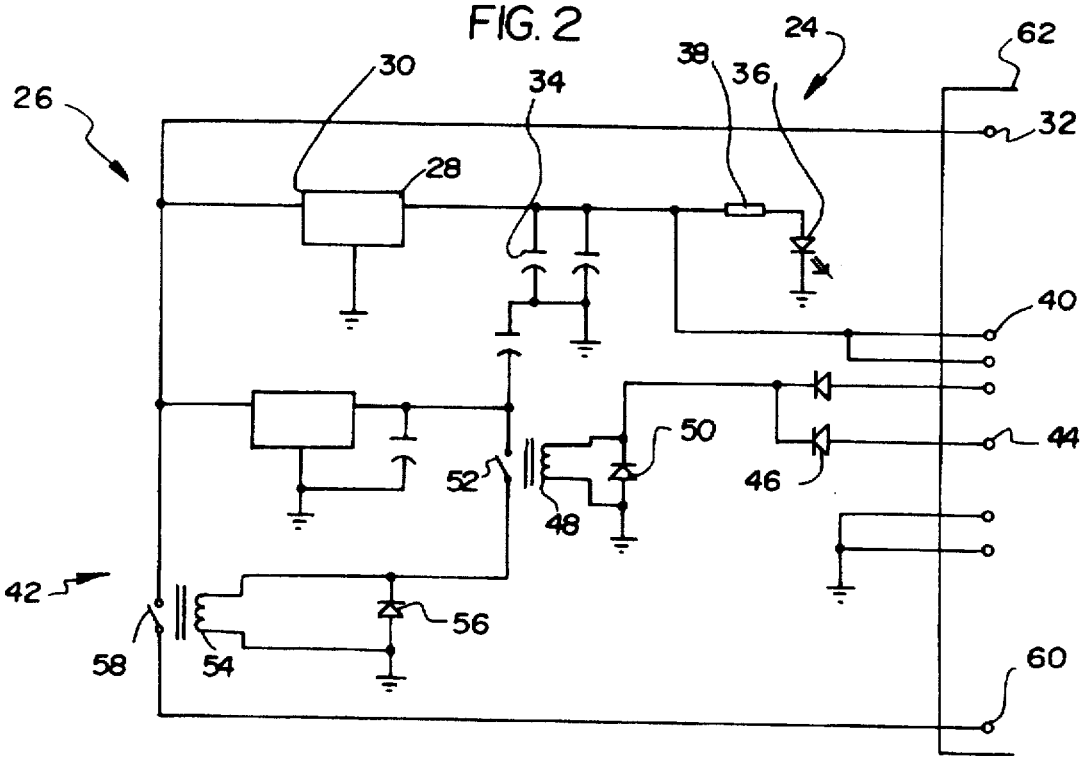
FIG. 2 is a schematic diagram of the interconnection network and the power means and switch means thereof.

With reference now to FIG. 2, an interconnection network 24 is included which has a power means 26. Such power means comprises a pair of voltage regulators 28 each with an input 30 connected to the battery supply via a battery terminal 32 for providing a voltage of 5 Volts at an output thereof. Each voltage regulator has a pair of capacitors 34 of unequal capacitance connected in parallel between the output of the associated voltage regulator and a ground. The capacitance values are preferably 10 uF and 0.01 uF. The large capacitor is included for abating large current ripples while the smaller capacitor is utilized to remove RF noise from the present network. In addition, the power means of the interconnection network further includes a light emitting diode 36 which is connected to the output of a first one of the voltage regulators. Connected in series with the light emitting diode is a resistor 38 for limiting the current to the diode. Such light emitting diode is adapted for indicating the presence of a voltage at the output of the first voltage regulator. A pair of power terminals 40 are both connected to the output of the first voltage regulator for being connected to the first and second electronic display modules. These terminals are provided for supplying power to the electronic display modules.

With reference still to FIG. 2, it can be seen that the interconnection network also has a switch means 42. Such means includes a pair of input terminals 44 connected to the electronic display modules for receiving the activation signal therefrom. A first and second diode 46 are connected in parallel and each have an anode connected to an associated input terminal and cathodes which are interconnected. It should be understood that the first and second diodes are necessary to protect the output of one electronic display module from receiving the activation signal of the other. Connected to cathodes of the first and second diodes is a first relay coil 48 with a third diode 50 connected in parallel therewith. Associated with such relay coil is a first, normally open, relay contact 52 connected to the output of a second one of the voltage regulators of the power means. In use, the first relay contact is adapted for closing upon the receipt of the activation signal by the first relay coil. A second relay coil 54 is connected between the first relay contact and ground with a fourth diode 56 connected in parallel therewith. The third and fourth diodes are provided to prevent back-emf associated with the relay coils. Finally, a second normally open relay contact 58 is connected between the battery supply and a horn terminal 60 which is in turn connected to the alarm horn. In use, the second relay contact supplies power to the horn upon the closing of the first relay contact.

As shown in FIG. 2, the battery terminal, power terminals, input terminals, horn terminals, and a pair of ground terminals are all situated within a parallel. port 62 for convenient interconnection with the remaining components. The parallel port is positioned on a side face of a weather proof housing which has an interior space for encapsulating the interconnection network.

The present invention thus affords a unique interconnection network which allows the operation of a pair of electronic display modules and further provides a loud secondary alarm in case of engine trouble. Further, the interconnection network is designed to afford optimum reliability.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An alarm module comprising:

at least one electronic display module situated on a boat with a display for indicating the status of the vital functions of the engine of the boat, the at least one electronic display adapted to produce an activation signal upon detection of an anomaly within the engine;

a direct current battery supply for supplying power;

an alarm horn for generating an audible alarm upon the receipt of power;

an interconnection network including power means having at least one voltage regulator connected to the battery supply for providing a lesser voltage an output thereof, each voltage regulator having a pair of capacitors of unequal capacitance connected in parallel between the output of the associated voltage regulator and a ground, the interconnection network further including switch means having at least one input terminal connected to the at least one electronic display module for receiving the activation signal therefrom, a first relay coil connected to the at least one input terminal, a first normally open relay contact connected to the output of the at least one voltage regulator of the power means for closing upon the receipt of the activation signal by the first relay coil, a second relay coil connected between the first relay contact and ground, and a second normally open relay contact connected between the battery supply and the alarm horn for supplying power to the horn upon the closing of the first relay contact.

2. An alarm module as set forth in claim 1 wherein the power means of the interconnection network further includes a light emitting diode connected to the output of a first one of the voltage regulators for indicating the presence of a voltage thereat.

3. An alarm module as set forth in claim 1 wherein the interconnection network further includes a pair of power terminals connected to the output of the at least one voltage regulator for being connected to the at least one electronic display module for supplying power thereto.

4. An alarm module as set forth in claim 1 wherein there are two electronic display modules and further included is a first and second diode each having an anode connected to an associated electronic display module via an associated input terminal, each diode further having a cathode interconnected to the first relay coil.

5. An alarm module as set forth in claim 1 wherein each relay has a diode connected in parallel therewith.

6. An new and improved alarm module comprising, in combination:

a first electronic display module situated on a starboard side of a boat with a display for indicating the status of vital functions of an engine of the boat, the first electronic display adapted to produce an activation signal upon detection of an anomaly within the engine;

a second electronic display module situated on a port side of a boat with a display for indicating the status of the vital functions of the engine of the boat, the second electronic display adapted to produce an activation signal upon detection of an anomaly within the engine;

a 12 Volt direct current battery supply for supplying power;

an alarm horn for generating an audible alarm upon the receipt of power;

an interconnection network including power means having a pair of voltage regulators each with an input connected to the battery supply for providing a voltage of 5 Volts at an output thereof, each voltage regulator having a pair of capacitors of unequal capacitance connected in parallel between the output of the associated voltage regulator and a ground, the power means of the interconnection network further including a light emitting diode connected to the output of a first one of the voltage regulators for indicating the presence of a voltage thereat and a pair of power terminals both connected to the output of the first voltage regulator for being connected to the first and second electronic display modules for supplying power thereto, the interconnection network further including switch means having a pair of input terminals connected to the electronic display modules for receiving the activation signal therefrom, a first and second diode each having an anode connected to an associated input terminal and cathodes which are interconnected, a first relay coil connected to cathodes of the first and second diodes and ground with a third diode connected in parallel therewith, a first normally open relay contact connected to the output of a second one of the voltage regulators of the power means for closing upon the receipt of the activation signal by the first relay coil, a second relay coil connected between the first relay contact and ground with a fourth diode connected in parallel therewith, a second normally open relay contact connected between the battery supply and the alarm horn for supplying power to the horn upon the closing of the first relay contact.

* * * * *